US006327722B1

(12) United States Patent
Noble

(10) Patent No.: US 6,327,722 B1
(45) Date of Patent: Dec. 11, 2001

(54) PORTABLE SPA PLATFORM AND METHOD OF USING

(76) Inventor: Kenneth L. Noble, 2273 Reflection Cir., Vista, CA (US) 92083

( * ) Notice: Subject to any disclaimer, the term of this patent is extended or adjusted under 35 U.S.C. 154(b) by 0 days.

(21) Appl. No.: 09/512,993

(22) Filed: Feb. 24, 2000

(51) Int. Cl.[7] ..... A47K 3/00

(52) U.S. Cl. ..... 4/592; 4/584; 4/548; 52/69

(58) Field of Search ..... 4/541.1, 584, 593, 4/548, 592, 498, 580; 52/72, 71, 69, 64, 98, 36.1; 16/225, DIG. 13; 428/36.5, 57, 60, 61

(56) References Cited

U.S. PATENT DOCUMENTS 3,650,872 * 3/1972 McKiernan ..... 156/304
3,731,449 * 5/1973 Kephart, Jr. ..... 52/631
4,885,820 * 12/1989 Erceg et al. ..... 16/225
5,140,789 * 8/1992 De Gooyer ..... 52/71
5,815,854 * 10/1998 Amaral et al. ..... 4/506
6,058,521 * 5/2000 O'Brien ..... 4/492
6,124,010 * 9/2000 Shih ..... 428/61
6,200,661 * 3/2001 Daniels et al. ..... 428/95

FOREIGN PATENT DOCUMENTS 6-225840 * 8/1994 (JP) ..... 4/584

* cited by examiner

*Primary Examiner*—Gregory L. Huson
*Assistant Examiner*—Huyen Le
(74) *Attorney, Agent, or Firm*—John J. Murphey

(57) ABSTRACT

A planar support pad for a spa comprising at least two individual planar sections of rigid plastic foam, each of the sections defined by broad top and bottom surfaces in parallel, spaced-apart arrangement and bounded by at least two peripheral edges, a rounded or beveled surface formed on at least one of the edges of the section for spreading the force of incidental contact therewith from a solid object over a broad area to reduce damage to the foam from the contact, and tape used adjacent at least another edge of the section for permitting joining one the section to another the section in contiguous assembly.

7 Claims, 2 Drawing Sheets

PORTABLE SPA PLATFORM AND METHOD OF USING

BACKGROUND OF THE INVENTION

1. Field of the Invention

This invention pertains to the field of spas, hot tubs or large whirlpool baths with ledges for seating several people. More particularly, it pertains to a prefabricated apparatus for leveling and supporting the spa and to a method of using the apparatus in the installation of the spa.

2. Description of the Prior Art

Spas or hot tubs are becoming more and more popular in private homes, condominiums, and apartments. They seat several people and thus become a center for socialization as well as for warm water hydrotherapy and exuding the benefits of sitting in a tub of warm water while a myriad of air bubbles envelops and massages one's body. In becoming more popular, spas are being made by many manufacturers having different designs and many different accessories.

However, consistent among all spas is the need to support them on a solid level surface and to comply with various building codes in the attachment of electric lines and water lines to the pumps and nozzles of the spa. Notwithstanding the location of the spa, i.e., whether it is set up in a room in the house or in the back yard, the common practice is to pour a pad of cement or concrete, level the top surface thereof, and set the spa on the pad. In addition, many spa owners wish to hide the electric lines and water lines from view so as to make the spa more aesthetically pleasing. This latter practice requires the electrician and the plumber to coordinate their design and their efforts to place their respective utility lines in an area wherein the concrete is to be poured so that, when the spa is set upon the cured concrete, the lines will match up with the connections on the spa itself and be able to be connected thereto without undue looping or swirling of the lines that may ruin the pleasing look of the finished spa.

Many spas are purchased on impulse at retail events, home & garden shows and fairs where many of them are set out for display accompanied by attentive salespersons. This impulse to purchase an appliance, for the relief of stress, for romance, and for treating the symptoms of arthritis, carries through to the swift delivery of the unit to the buyer's home and the expectation of quick installation for near-immediate use. Imagine the surprise to the buyer when they are informed that they will need to have a cement and/or concrete slab poured, usually six to ten feet square and from three to six inches thick. This requires the services of a contractor, the likelihood of having to obtain a building permit, and a cement curing time of three to four days. Even worse, the installation process cannot be started until the buyer selects an appropriate site for the spa along with the hope that unforseen circumstances do not require it to be moved to a different location thus requiring the entire pad-pouring process to be repeated.

Often, this delay in installation cools the ardor of the spa buyer such that, after waiting the 7 to 8 days for the concrete pad to be designed, laid out, piped with electric and possibly water lines, the concrete poured and cured, and spending upwards of $600 to $1200 to have all that work done, the spa is no longer as appealing with the family as it originally was. This disappointment passes on to neighbors and friends and can work against the popularity of further sales of spas.

Accordingly, there is a significant need for another way to install and support a spa that is not a laden with the disadvantages that go with a poured concrete pad as outlined above.

SUMMARY OF THE INVENTION

This invention is a novel, prefabricated, portable spa platform and method of using it to locate and support a spa on a surface that is free of the disadvantages heretofore described with respect to the standard poured concrete support pad. Generally, the invention comprises at least two individual planar sections of rigid plastic foam, each section defined by broad top and bottom surfaces, in parallel, spaced-apart arrangement and bounded by a plurality of peripheral edges. Each section is made in identical finite thickness and each section defines at least one assembly edge arranged to allow the two sections to be assembled in contiguous arrangement to form a full-size pad for placement under the spa. Means in the preferred form of a wide length of adhesive tape or bonded fabric is placed along the top surfaces, spanning both sections along their contiguous edges to not only attach the two sections together but to allow one section to be tilted upward with respect to the other section to allow easier installation of the electric lines and the water lines to the spa.

In addition, the invention involves the method of placing the two sections of rigid plastic foam together on top of the ground or on a layer of leveling sand on top of the ground, temporarily adhering them together along their contiguous top surfaces, tilting one of the sections upward to allow accurate placement and installation of electric and water lines upward through the foam, and then returning the tilted section to planar assembly with the other section to form the full-size spa support pad.

The advantages of this invention are many. For instance, the sections are light weight and can be brought to the home or other location of the spa in a shipping box as opposed to having to be poured in place. The installation of the pad is a do-it-yourself project that can be accomplished by either the buyer or a general handyman as opposed to a more expensive general contractor. Generally, no building permit will be required as opposed to the time and cost of obtaining a building permit for the poured concrete slab. The sections can be made in various sizes to fit all makes and models of self-contained portable spas and/or hot tubs. The two sections and their installation will save on money spent to erect the spa, perhaps as much as two-thirds of the cost of the poured concrete pad with its permits and general contractor costs, and overcomes a major obstacle or objection from sale through installation, namely, the requirement of a poured concrete pad.

The invention will reduce the time involved in setting up the spa - in a matters of hours compared to many days or even a week with the poured concrete pad. The sections can be placed on any level surface including grass, dirt and gravel thus eliminating the need for concrete forms and the like. Placement of the sections can be temporary as well as permanent so that the spa can be moved to a new location with ease and without the necessity of going through the pouring of new concrete and its attendant costs and delays. The foam making up the sections is easy to be pierced to pass the water and electric lines from below the pad upward therethrough to the connections on the spa. Segmented design of the pad sections allows tilting of one section for more accurate placement of the utility lines. The buyer can take the sections home along with purchase of the spa and move the assembled sections about his yard to find the most convenient place to locate the spa.

Accordingly, the main object of this invention is a light weight, inexpensive foundation for a spa. Other objects of the invention include a spa support pad that is portable and can be carried home by the buyer and used without engaging the services of a cement contractor; a spa support pad that may be installed as a do-it-yourself project without the requirement of obtaining building permits, having the electrician and plumber attend expensive meetings with the general contractor in order to coordinate the installation of utility lines under the poured concrete pad; where the support pad may be easily fabricated in various sizes to fit all makes and models of self-contained portable spas and/or hot tub; a means to reduce the installation time from many days or weeks to a few hours thereby allowing the buyer to begin enjoying the newly purchased spa almost immediately upon bringing it home; a spa support pad that is truly portable and that can be moved from one location to another, at the whim of the buyer, without enduring the tearing up of the old poured concrete pad and installing a new pad along with the costs and delays attendant thereto; and a means of segmenting the support pad to allow tilting of the pad to permit more accurate placement of utility lines through the support pad.

These and other objects of the invention will become more clear when one reads the following specification, taken together with the drawings that are attached hereto. The scope of protection sought by the inventor may be gleaned from a fair reading of the Claims that conclude this specification.

DESCRIPTION OF THE PREFERRED EMBODIMENT

Figure 1:
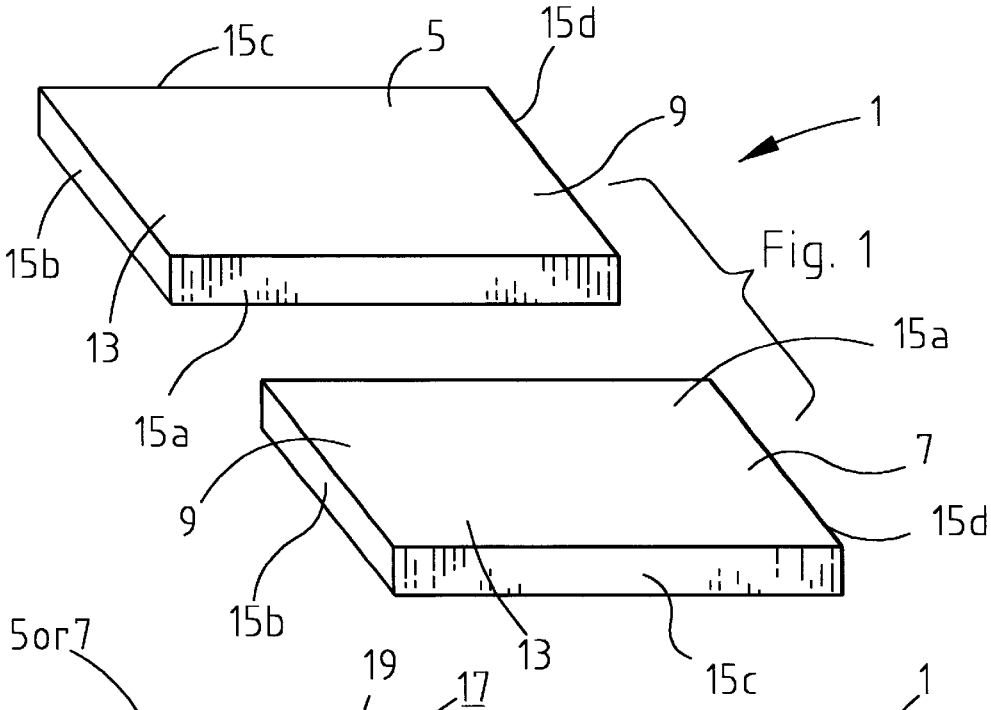
FIG. 1 is a perspective view of two rectangular rigid foam sections that go together along a pair of straight assembly edges to make up a spa pad.
Figure 2:
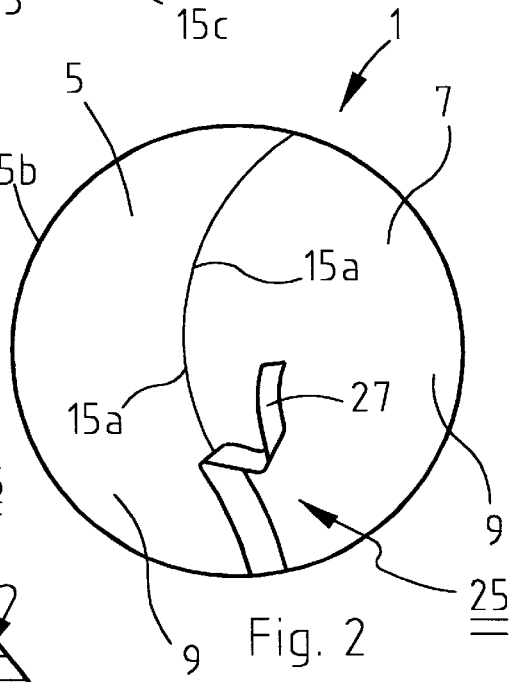
FIG. 2 is a top view of another embodiment of the two semi-circular rigid foam sections that go together along a pair of curved assembly edges to make up a spa pad.

Turning now to the drawings wherein elements are identified by numbers and like elements are identified by like numbers throughout the six figures, the invention is depicted in FIGS. 1 and 2 as a planar support pad 1 for a spa 3 comprising at least first and second individual rectangular planar sections, 5 and 7 respectively, made of rigid plastic foam of finite thickness, such as three inches, each said section defined by broad, planar top surfaces 9 and planar bottom surfaces 13, in parallel, spaced-apart arrangement, and bounded by peripheral edges 15*a,* 15*b,* 15*c* and 15*d.* A spa pad made of more than two sections is fully contemplated in this invention. In addition, while the preferred embodiment calls for sections 5 and 7 to be combined in rectangular outline (FIGS. 1 and 3), circular (FIG. 2) and other non-conventional outlines of pad 1 are usable herein and are fully contemplated in this invention.

At least one peripheral edge 15*a* of each section 5 and 7 is defined as an assembly edge and arranged for contiguous assembly therebetween and fully therealong to join sections 5 and 7 and form a full-size pad for supporting spa 3 thereon. The assembly edges 15*a* of each section 5 and 7 may be sculpted in a variety of matching, mating, or interlocking configurations and be fully contemplated within the scope of this invention. However, a simple straight edge, the plane of which lies orthogonal to top and bottom surfaces 9 and 13, is considered the most practical from the standpoint of manufacture, use and cost.

Figure 4:
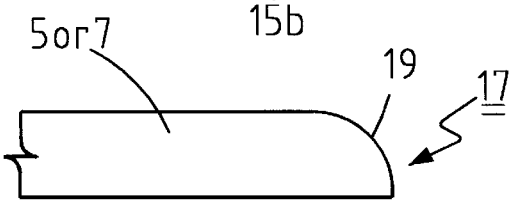
FIG. 4 is a partial side view of a rigid foam section showing the curved edge to reduce damage to the foam by inadvertently kicking it with one's foot.
Figure 5:
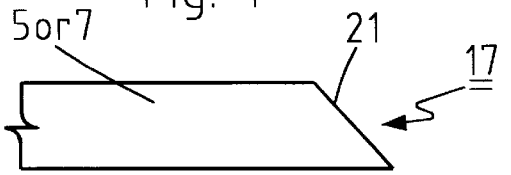
FIG. 5 is a partial side view of a rigid foam section showing the beveled edge to reduce damage to the foam by inadvertently kicking it with one's foot; and, FIG. 6 is a perspective view of a fully assembled spa pad where it is coated with a moisture impervious material.

Means 17 are formed on edges 15*b,* 15*c,* and 15*d* (i.e., not on assembly edge 15*a* ) of each section for spreading the force of incidental contact therewith from a solid object, such as a person's shoe, over a broad area to reduce damage to the foam structure from such contact. As shown in FIGS. 4 and 5, outside edges 15*b,* 15*c,* and 15*d* are rounded at 19 (FIG. 4) or beveled at 21 (FIG. 5) in order to reduce damage to the foam structure when a person's foot comes in contact with the periphery of either of section 5 or section 7. The overall pad size is near to equal that of the overall footprint of the spa and it is not unusual to have a person stand so close to the spa that their foot and shoe pass into contact with support pad 1. Accordingly, it is desired to round or bevel the outside edges of foam sections 5 and 7 to lower the amount of damage to the foam caused by this unwanted contact. In the rounded version, the radius of curvature is preferred to be equal to one-half the thickness of the section.

Figure 6:
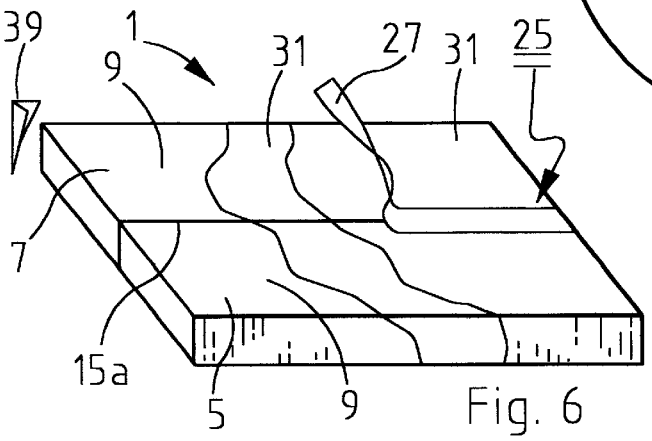

Means 25 are formed, as shown in FIGS. 2 and 6, adjacent edges 15*a* of both sections 5 and 7, for permitting joining the sections to allow them to be held together during installation of spa 3 and in some cases also to allow the spa and one section to be pivoted upward along the junction between the two sections to permit the utility lines to be passed from outside spa 3 along the ground under pad 1 and then brought upward through the foam to above pad 1 for junction with connections on spa 3.

Figure 3:
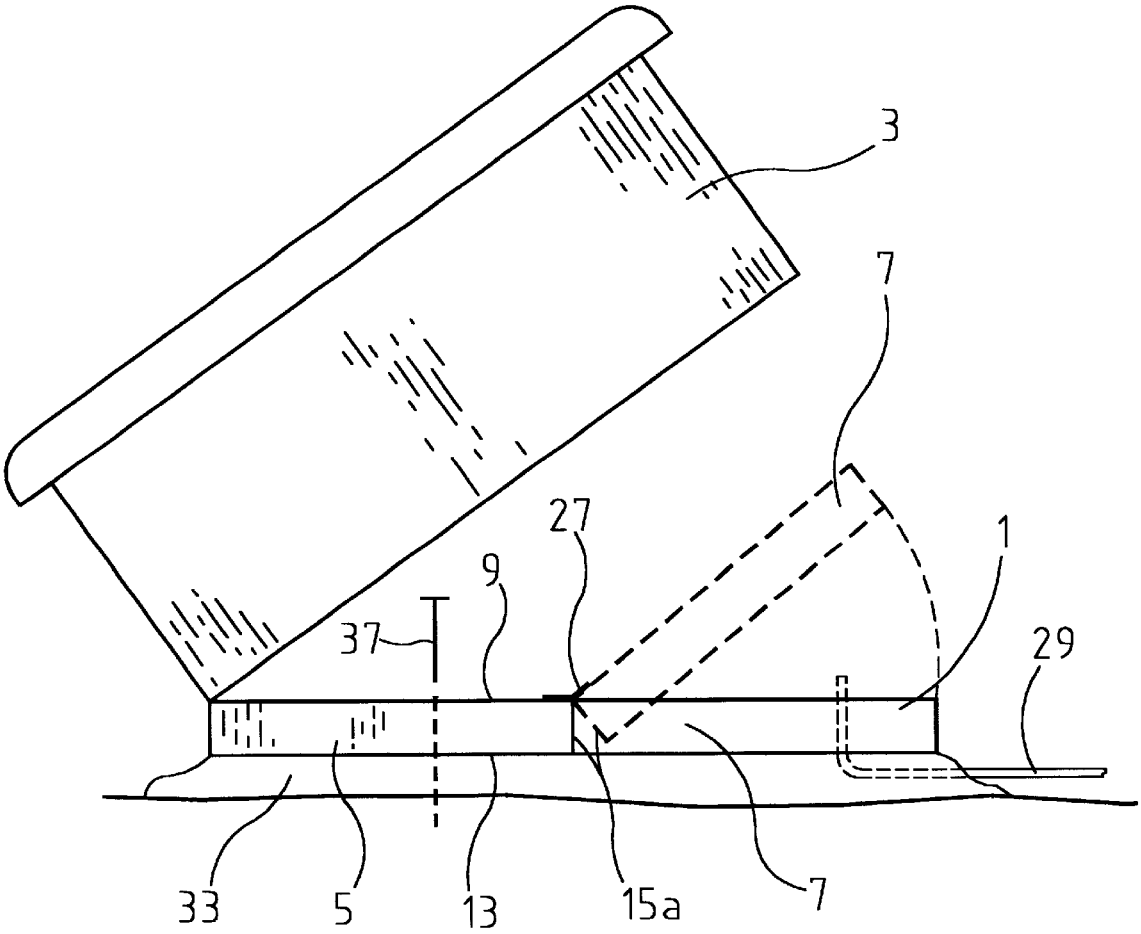
FIG. 3 is a side view of a spa set upon a pad of this invention where the spa is tilted at one end and one section of the rigid foam is pivoted upward to allow installation of the utility lines up through the foam section.

As shown in FIGS. 2, 3 and 6, means 25 preferably take the form of a length of tape 27, such as duct tape, having an adhesive layer on one side thereof, placed along the top surface 9 and overlapping each section 5 and 7, adjacent the joining edges 15*a* of each section. In another embodiment, a strip of fabric, sheet plastic or the like, without adhesive, may be used and locked into place on foam top surface 9 and held in place with a moisture barrier coating or other paint. This provides for holding sections 5 and 7 together while spa 3 is lowered in place on top of pad 1. Then, as shown in FIG. 3, spa 3 is tilted upward and section 7 is pivoted upward along means 25 and assembly edge 15*a* to allow the utility lines 29 (shown in dotted outline) to be brought into pad 1 and connected to spa 3. When connection is complete, section 7 is pivoted downward into planar arrangement with section 5 and spa 3 is lowered onto pad 1 to complete the installation.

It is preferred that the rigid plastic foam used in this invention be a non-reticulated, (closed-cell) foam. Typical foams useable herein are foams of polystyrene, polyvinylchloride, polyurethane, acrylonitrile-butadiene-styrene, alloys and blends thereof It is preferred that rigid foam sections 5 and 7 be treated to insure against the influx of moisture from the ground. While some moisture may be tolerated, too much moisture may allow mold and other undesirable life forms to propagate in the foam and about the pad which may cause noxious odors that may bother the users of spa 1 and reduce the enjoyment of the spa. While the rigid foam is desired to be closed-cell, there invariably is some open cells that may permit the entrance of moisture if a barrier coat 31 is not applied to the foam surface. In many cases one coat of certain barrier material is sufficient, such as Foam Magic®, an EPS bonding cement and adhesive, marketed by Western States Wholesale, 1420 S. Bon View, Ontario, Calif. 91761. However, in other cases, such as where much ground moisture is expected, a two-coat application of a barrier coat 31 such as a first coat of Safe T Prime®and a second coat of Safe T Kote®, manufactured by ORD, Inc., 1895 16$^{th}$ Street SE, Salem, Oreg. 97302, is desired. both these coatings and others not mentioned herein are fully contemplated in this invention. Such a coating 31 is shown in FIG. 6.

Inimitable to this invention is a method of supporting spa 1 on a surface comprising the steps of providing two individual planar sections 5 and 7 of rigid plastic foam, each said section defined by broad top and bottom flat surfaces 9 and 13 in parallel, spaced-apart arrangement, each section of identical finite thickness, such as three inches thick, and having at least one assembly edge 15*a* arranged for contiguous assembly therebetween. Sections 5 and 7 are assembled in planar, contiguous arrangement at the intended location of spa 1. A means 17 is applied along contiguous assembly edges 15*a* of both sections adjacent top surface 9 of each section for temporarily adhering them together. Section 5 is then pivoted upward, out of the common plane of assembled sections 5 and 7, to provide access under pad 1 for installation of utility lines therein and passing upward through the rigid foam for installation of utility lines. Following installation of utility lines under pad 1 and upward through pad 1 to connections with the spa elements, section 5 is then pivoted downward into planar arrangement with section 7 to complete the installation. A layer 33 of sand may be placed under section 5 and 7 to bring them level when used on uneven or non-level ground.

As shown in FIG. 6, a pin 37 may be hammered down into foam section 5 or 7 and into the ground or other support surface below. This arrangement is generally considered temporary because, after spa 3 is set on pad 1 and filled with water, the weight of the water filled spa is sufficient to hold pad 1 in its proper location.

As shown in FIG. 6, a corner pin 39, of the type usually used with tents and other light camping gear, and having two sides set orthogonal to each other, may be used at the corners of sections 5 and 7 to insure they do not shift from their desired location while bringing the heavy spa 3 to sit on pad 1. Pins 39 may be removed after installation of spa 3 on pad 1.

While the invention has been described with reference to a particular embodiment thereof, those skilled in the art will be able to make various modifications to the described embodiment of the invention without departing from the true spirit and scope thereof It is intended that all combinations of elements and steps which perform substantially the same function in substantially the same way to achieve substantially the same result are within the scope of this invention.

What is claimed is:

1. A method of supporting a spa on a surface comprising the steps of:

a) providing two individual planar sections of rigid plastic foam, each said section defined by broad top and bottom flat surfaces in parallel, spaced apart arrangement, each said section of identical finite thickness, and each said section defining at least one assembly edge arranged for contiguous assembly therebetween;

b) assembling said sections in planar, contiguous arrangement at the intended location of the spa;

c) applying means along said contiguous respective edges of said sections for temporarily adhering said sections together in pivotal arrangement along said top surfaces;

d) tilting up one of said sections, out of the common plane of said assembled sections, to provide access to the base of said tilted section for installation of utility lines therein; and, e) return said tilted section to said planar arrangement, following installation of utility lines therein, for receipt thereon of said spa.

2. The method of supporting a spa on a surface of claim 1 further including the additional step of temporarily pinning at least one said section to the surface on which said sections are to be ultimately located under the spa.

3. The method of supporting a spa on a surface of claim 1 further including the additional step of fixing the location of said sections with pins placed adjacent an edge of a section.

4. The method of supporting a spa on a surface of claim 1 further including the additional step of placing sand underneath said assembled sections to provide a level surface on which to locate said assembled sections.

5. The product of the method of claim 1.

6. A method of supporting a spa on a surface comprising the steps of:

a) providing a plurality of individual planar sections of rigid plastic, each said section defined by broad top and bottom flat surfaces in parallel, spaced-apart arrangement, each said section of identical finite thickness, and each said section defining at least one assembly edge arranged for contiguous assembly therebetween;

b) assembling said sections at their respective assembly edges in planar, contiguous arrangement at the intended location of the spa; and, c) applying means along said assembled assembly edges for temporarily adhering said sections together in contiguous, pivotal assembly.

7. The product of the method of claim 6.

* * * * *